United States Patent [19]

Bromley et al.

[11] 4,228,120

[45] Oct. 14, 1980

[54] PROCESS FOR NYLON 66 YARN HAVING A SOFT HAND

[75] Inventors: James E. Bromley, Pensacola, Fla.; Michael M. McNamara, Gaffney, S.C.; Wayne T. Mowe, Pensacola, Fla.

[73] Assignee: Monsanto Company, St. Louis, Mo.

[21] Appl. No.: 898,746

[22] Filed: Apr. 21, 1978

Related U.S. Application Data

[60] Division of Ser. No. 628,721, Nov. 4, 1975, Pat. No. 4,093,147, which is a continuation-in-part of Ser. No. 482,962, Jun. 25, 1974, abandoned.

[51] Int. Cl.[3] ..... B29C 25/00

[52] U.S. Cl. ..... 264/235.6; 264/176 F; 264/210.5

[58] Field of Search ..... 264/176 F, 210 F, 235, 264/210.5, 235.6

[56] References Cited

U.S. PATENT DOCUMENTS

| | | | |
|---|---|---|---|
| 3,553,305 | 1/1971 | Au | 264/210 F |
| 3,946,100 | 3/1976 | Davis et al. | 264/210 F |
| 4,123,492 | 10/1978 | McNamara et al. | 264/210 F |

FOREIGN PATENT DOCUMENTS

| | | | |
|---|---|---|---|
| 2117659 | 10/1972 | Fed. Rep. of Germany | 264/210 F |
| 46-843 | 1/1971 | Japan | 264/177 F |
| 47-45615 | 11/1972 | Japan | 264/210 F |
| 48-28012 | 8/1973 | Japan | 264/210 F |

*Primary Examiner*—Jay H. Woo
*Attorney, Agent, or Firm*—Kelly O. Corley

[57] ABSTRACT

Nylon 66 yarn having particular stress-strain properties, typically also having a soft, luxuriant hand in fabric form. As compared to conventional nylon 66 with comparable boiling water shrinkage, the novel yarn exhibits a higher modulus at break, a lower modulus at 10% elongation, a positive stress index, and excellent denier uniformity. The process involves subjecting the yarn, within 0.016 to 0.11 seconds after solidification of the filaments, to a tension of 0.2 and 1.5 grams per final denier and heating the yarn to a temperature between 50° and 250° C. long enough to reduce yarn retraction below 1%.

6 Claims, 5 Drawing Figures

PROCESS FOR NYLON 66 YARN HAVING A SOFT HAND

This is a division of application Ser. No. 628,721 filed Nov. 4, 1975, and now U.S. Pat. No. 4,093,147, which is a continuation in part of Ser. No. 482,962 filed June 25, 1974, now abandoned.

The invention relates to nylon 66 yarn having a novel combination of physical properties and excellent uniformity.

As used in the specification and claims, the term "nylon 66" shall mean synthetic linear polyamides containing in the polymer molecule at least 85% by weight of recurring structural units of the formula $$\left[ -\overset{\overset{\displaystyle O}{\|}}{C}-(CH_2)_4-\overset{\overset{\displaystyle O}{\|}}{C}-\overset{\overset{\displaystyle H}{|}}{N}-(CH_2)_6-\overset{\overset{\displaystyle H}{|}}{N}- \right]$$

The polymer and resulting yarn may contain the usual minor amounts of such additives as are known in the art, such as delustrants or pigments, light stabilizers, heat and oxidation stabilizers, additives for reducing static, additives for modifying dyeability, etc. The polymer must be of fiber-forming molecular weight in order to melt spin into yarn. The term "yarn" as used herein includes continuous filaments and staple fibers.

One prior art process for making nylon 66 yarn is the conventional melt spinning process wherein the spun yarn is collected on spin cakes or packages, the spin cakes then being removed from the spinning machine and placed on drawing machines where the drawing operation is performed. By way of example, split process spun yarn having 188 denier can be collected at 1500 y.p.m., corresponding to a throughput of of 28.7 grams per minute per spinning position. This spun yarn is then drawn to 70 denier on a separate machine. Productivity per spinning position is thus reasonably high, but the discontinuous or split process is expensive because of the necessity for manually handling the spun yarn, and the drawn yarn properties are somewhat variable.

A second known process for making nylon 66 yarn is a continuous or coupled process wherein the freshly spun yarn is fed in several wraps around a feed roll and separator roll running at a given peripheral speed to a draw roll and associated separator roll running at a higher peripheral speed, the yarn then being packaged. Optionally, the yarn may be subjected to two successive drawing stages as disclosed in U.S. Pat. No. 3,091,015. While coupled process yarn is usually more uniform than yarn produced by the split process, measurable denier variations along the yarn still occur. In addition, drawing and winding speeds in the coupled process are generally limited to less than about 3500–4000 yards per minute (y.p.m.) in practice because of increasingly poor performance and decreased yields of prime quality yarn as speed is increased. This then limits the practical spinning speed and hence the productivity of a spinning position to less than those of a split process spinning position. A spinning position making 70 drawn denier yarn by the coupled process at 3500 yards per minute will have a throughput of only 24.9 grams per minute. In effect, therefore, the coupled process permits gains in product quality at the expense of productivity per spinning position.

A third process for making polyamide yarn is by wet spinning, wherein the polymer is dissolved in a solvent (such as formic acid) and extruded through a spinneret into a coagulation bath. While this gives a yarn with a soft hand, production costs are excessive as compared to melt spinning. Furthermore, the filaments have irregular cross sectional configurations along their lengths, causing low tenacity and a lack of control over the surface sheen or luster of the yarn. By way of contrast, melt spun filaments have substantially constant cross sectional configurations along their lengths, higher tenacities, and controllable surface sheen or luster.

According to the invention, these and other difficulties are avoided by the provision of nylon 66 yarns having novel combinations of properties and capable of being made more economically and at higher speeds than those permitted by the above-noted processes. Yarn according to the invention can have uniformity superior to the best yarns made by the coupled process, and with higher productivity than either the split or the coupled processes. Thus, a 70 denier yarn according to the present invention can readily be made with excellent yields at speeds of 5000 yards per minute or higher. At 5000 yards per minute, throughput for this denier is 35.6 grams per minute per spinning position. This is about 24% more productivity than the split process and about 43% more productivity than the coupled process.

In addition to the lowered manufacturing cost permitted by the higher productivity, the nylon 66 yarn of the invention typically exhibits in fabric form a distinctive soft, luxuriant hand, particularly when the yarn is textured prior to incorporation in the fabric.

As is known, the hand of fabrics (the way they feel to the touch) depends not only on the initial properties of the yarn, but also on the fabric construction and on the conditions to which the fabric is subjected during scouring, dyeing and finishing. Various test fabrics made from yarns according to the invention exhibit a distinctive soft, luxuriant hand when compared to otherwise identical control fabrics made from conventional nylon 66 yarns having the same denier and number of filaments, the fabrics having been scoured, dyed and finished under the same conditions.

These test fabrics do not feel crisp to a light touch, as do fabrics made from wool, silk, or conventional nylon 66, and accordingly are more comfortable in garments worn next to the skin. Generally speaking, the soft hand is more apparent in heavier fabric constructions than in lighter construction. For example, yarns textured by the false-twist heat-set process and knitted as 210 denier, 102 filament, balanced-torque plied yarns into mens' half-hose have a softer hand with test yarns according to the invention than with either split process or coupled process control yarns. The soft hand is typically not as pronounced in lighter constructions. Thus, sample tubes knitted from 70 denier, 34 filament flat test and control yarns on the Lawson-Hemphill Fiber Analysis Knitter exhibit small hand differences than in the mens' half-hose mentioned above, although the hand differences are still detectable.

According to one of its broadest aspects, the invention comprises a process of melt-spinning nylon 66 comprising extruding nylon 66 polymer of fiber-forming molecular weight as a plurality of molten streams, solidifying the streams into solid filaments while withdrawing the filaments from the streams at a speed of at least 2285 meters per minute and sufficiently high to provide a tension within the range between 0.2 and 1.5 grams per final denier, (the denier of the yarn on the bobbin) maintaining the filaments under a tension within this range while forwarding them at least 0.16 and less than 0.11 seconds (preferably between 0.03 and 0.06 seconds) after solidification to a treatment zone wherein they are heated to between 50° C. and 250° C. for a period sufficient to reduce the yarn retraction of less than 1%, and withdrawing the filaments from the treatment zone.

According to another of its broadest aspects, the invention comprises a process of melt-spinning nylon 66 comprising extruding nylon 66 of fiber forming molecular weight as a plurality of molten streams and solidifying the streams into solid filaments while withdrawing the filaments from the streams at a speed sufficient to produce a final spun yarn having a Herman's crystalline orientation Fc of at least 0.78, and preferably at least 0.85, and winding the yarn on a bobbin.

According to another of its broadest aspects, the invention comprises a process of melt-spinning nylon 66 comprising extruding nylon 66 of fiber forming molecular weight as a plurality of molten streams and solidifying the streams into solid filaments while withdrawing the filaments from the streams at a speed sufficient to produce a final spun yarn having a crystallite hydrogen bonded sheet width no greater than 85% (preferably no greater than 75%) of the crystallite hydrogen bonded sheet width of a reference spun yarn sample, and winding the yarn on a bobbin.

A further general aspect is the provision of flat nylon 66 yarn having a substantially constant cross sectional configuration along its length, a shrinkage less than 8.5%, an initial modulus greater than 15 g/d, and a positive stress index $\alpha$.

A further general aspect is the provision of flat nylon 66 yarn having a substantially constant cross sectional configuration along its length, a shrinkage S less than 8.5%, an initial modulus of at least 17 g/d and a modulus ratio less than 3.

A further general aspect is the provision of flat nylon 66 yarn having a substantially constant cross sectional configuration along its length, a shrinkage S less than 8.5%, an initial modulus of at least 15 g/d, and a 10% modulus less than 22 g/d.

A further general aspect is the provision of flat nylon 66 yarn having a substantially constant cross sectional configuration along its length, a shrinkage S less than 8.5%, a 10% modulus less than 22 g/d, a final modulus greater than 7.5 g/d, and a modulus ratio less than 3.

As used in the specification and claims, the term "final spun yarn" shall mean yarn sample taken just prior to the yarn touching the first solid element after the yarn has solidified.

A primary object of the invention is to provide nylon 66 yarns having novel and useful properties.

A further object is to provide nylon 66 yarns of the above character adapted for use in weaving yarns.

A further object is to provide nylon 66 yarns of the above character adapted for texturing.

A further object is to provide nylon 66 yarns of the above character adapted for use as knitted flat yarns.

A further object is to provide nylon 66 yarns of the above character which, when converted into fabric, exhibit a soft and luxuriant hand.

A further object is to provide a process for making nylon 66 yarns of the above character more economically and at higher speeds than either split-process or coupled-process yarns.

Other objects will appear in part hereinafter and will in part be obvious from the following detailed description taken in connection with the accompanying drawings, wherein.

Figure 1:
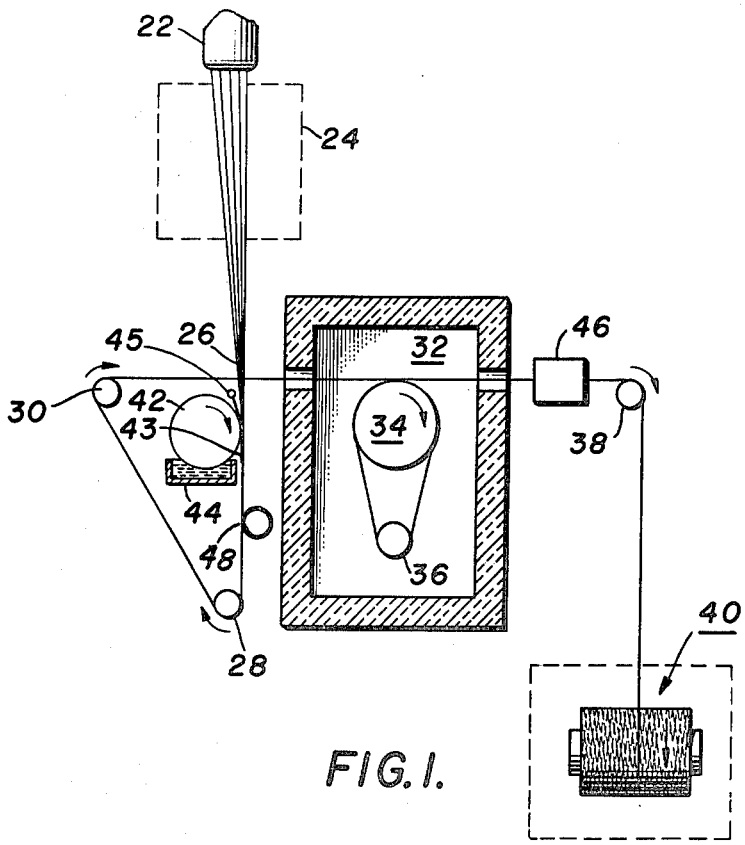
FIG. 1 is a schematic elevation view of the preferred apparatus for producing the novel yarns.
Figure 2:
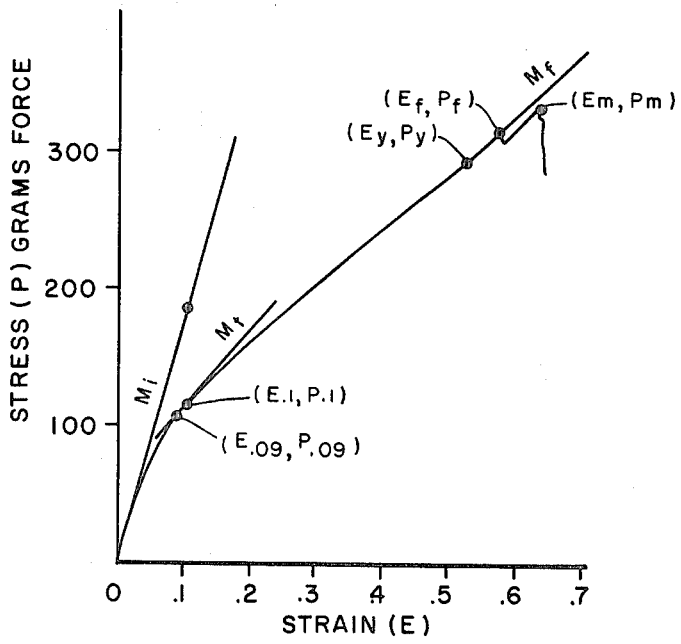
FIG. 2 shows the stress-strain properties of the yarn.

As illustrated in FIG. 1, molten nylon 66 polymer is metered and extruded from a non-illustrated conventional block through spinneret 22 into quench zone 24 as a plurality of molten streams. The streams are cooled and solidified in zone 24 by a flow of transversely moving air into filaments which constitute yarn 26. Yarn 26 passes in partial wraps around rolls 28 and 30 prior to entering insulated chamber 32. Driven heated feed roll 34 and its associated skewed separator roll 36 are mounted within chamber 32 for forwarding yarn 26, which passes in several separated wraps around rolls 34 and 36 prior to leaving chamber 32. Yarn 26 next passes in a partial wrap around roll 38 and then downwardly to schematically illustrated yarn winding apparatus 40.

In the preferred embodiment, spin finish is applied by slowly rotating conventional finish roll 42, whose lower surface is immersed in liquid finish carried in trough 44. A conventional gauze finish skirt 43 transfers the finish from roll 42 to yarn 26, skirt 43 being anchored at 45. While it is preferred to locate finish roll 42 above roll 28 as illustrated, it may be located between rolls 28 and 30 or at other locations. Optionally, the filaments of yarn 26 may be interlaced or entangled by an interlacing apparatus 46 of any desired design.

Rolls 28, 30 and 38 may be supported on air bearings, and at least one of rolls 28 and 30 may be driven at a controlled speed for controlling the tension of the yarn entering chamber 32. Roll 38 may be driven at a controlled speed for adjusting the tension in yarn 26 passing through device 46, and for adjusting the winding tension.

PREFERRED APPARATUS

The following is a specific example of preferred exemplary apparatus for preparing the novel yarn according to the invention. A 34-capillary spinneret is used, the diameter and length of each capillary being 0.009 inch and 0.012 inch, respectively. Each of rolls 28, 30 and 38 have a diameter of 1.908 inches in the region of yarn contact, while rolls 34 and 36 have respective diameters of 7.625 and 2.0 inches. Roll 28 is located 167 inches below spinneret 22. Yarn 26 contacts roll 28 in a partial wrap of about 170 degrees, and contacts roll 30 in a partial wrap of about 100 degrees. The distance from roll 28 to roll 30 is 35 inches, while the distance from roll 30 to roll 34 is 12 inches. Roll 34 is internally heated to desired surface temperatures as indicated below. Separator roll 36 is spaced from roll 34 so that 8 wraps of yarn 26 about rolls 34 and 36 will give a total yarn contact time with feed roll 34 of about 38 milliseconds when feed roll 34 has a peripheral speed of 5000 yards per minute. The distance from roll 34 to roll 38 is 19.75 inches.

Conventional spin finish is applied to yarn 26 by roll 42 at a level of one weight percent oil on yarn. Optional roll 48 is identical to rolls 28, 30 and 38, and is positioned to control and stabilize the small degree of wrap of yarn 26 about roll 42 and skirt 43. Preferably yarn 26 is deflected only slightly by roll 42 and skirt 43, a partial wrap of only one or two degrees usually being sufficient.

Rolls 28, 30, 38 and 48 are supported on air bearings, fed from a first source of pressurized air, and are equipped to be driven by air turbines constructed according to New Departure Hyatt Bearings' Drawing XB-21044. These rolls are available from New Departure Hyatt Bearings, Sandusky, Ohio. The turbines are supplied with air from separate sources of pressurized air, the turbine air for each turbine being fed through a nozzle having a throat diameter of 0.063 inch. Each nozzle diameter increases near the exit in a region beginning 1/16 inch from the nozzle exit and extending to the exit in the form of a segment of a 16° cone. The nozzle is positioned adjacent the turbine and aligned so that the following approximate relationships are obtained with no yarn on the roll.

TABLE 1

| SUPPLY PRESSURE, PSIG | RPM OF ROLL |
|---|---|
| 10 | 9000 |
| 20 | 15000 |
| 30 | 19500 |
| 40 | 24000 |
| 50 | 28000 |
| 60 | 31000 |

As reported in the following tables, positive air pressure indicates that the turbine assists the yarn in driving the roll in the direction of yarn travel, while a minus sign (−) before air pressure indicates that the turbine is reversed so that the roll would rotate in the opposite direction if not contacted by the yarn. The roll in contact with the yarn thus runs increasingly slowly as "negative" air pressure (pressure preceded by a minus sign) increases.

EXEMPLARY PROCESSES

Table 2 discloses several exemplary processes for operating the FIG. 1 apparatus so as to produce the novel yarns of the invention. The polymer contains 2% $TiO_2$ by weight and is selected so that the resulting yarn will have a relative viscosity of about 48–50. For all items, quenching air is supplied at a temperature of 77° F. and a relative humidity of 72%. The average velocity of the quenching air is 83.3 feet per minute, and the height of quench zone 24 is 46 inches.

The reported tensions are as follows: $t_1$ is measured downstream of roll 38, $t_2$ is measured between device 46 and roll 38, $t_3$ is measured as the yarn leaves chamber 32, $t_4$ is measured between roll 30 and chamber 32, $t_5$ is measured between rolls 28 and 30, $t_6$ is measured between roll 28 and finish roll 42, and $t_7$ is measured just above roll 42. A Rothschild Tensiometer Model R1092 is used for measuring all tensions.

TABLE 2

| | PROCESS CONDITIONS | | | | | | | |
|---|---|---|---|---|---|---|---|---|
| ITEM | A | B | C | D | E | F | G | H |
| Feed Roll Surface Temp. (°C.) | 30 | 30 | 120 | 120 | 120 | 190 | 185 | 185 |
| Roll 28 Speed (YPM) | 4172 | 3616 | 4130 | 3629 | 2910 | 4026 | 3348 | 2979 |
| Roll 28 Turbine Air Press. (PSIG) | 0 | −30 | 0 | −30 | −60 | 0 | −30 | −60 |
| Feed Roll 34 (YPM) | 5001 | 5001 | 5001 | 5001 | 5001 | 5001 | 5001 | 5001 |
| Winding Speed (YPM) | 4821 | 4808 | 4933 | 4940 | 4883 | 4967 | 4926 | 4926 |
| Underdrive (%) | 3.6 | 3.8 | 1.4 | 1.2 | 2.4 | 0.7 | 1.5 | 1.5 |
| Roll 30 Turbine Air Press (PSIG) | 0 | 0 | 0 | 0 | 0 | 0 | 0 | 0 |
| Roll 38 Speed (YPM) | 4832 | 4862 | 4972 | 5004 | 5006 | 5316 | 5490 | 5451 |
| Tensions (GMS) | | | | | | | | |
| $t_1$ | 8.5 | 8.5 | 7.5 | 8.0 | 8.0 | 8.0 | 7.5 | 7.5 |
| $t_2$ | 9.5 | 12.0 | 10.0 | 11.0 | 13.0 | 11.5 | 16.0 | 10.0 |
| $t_3$ | 7.0 | 7.0 | 7.3 | 8.0 | 7.0 | 7.5 | 8.8 | 8.0 |
| $t_4$ | 50 | 55 | 57 | 50 | 82 | 53 | 62 | 74 |
| $t_5$ | 49 | 54 | 50 | 48 | 71 | 51 | 50 | 65 |
| $t_6$ | 43 | 42 | 43 | 44 | 40 | 46 | 38 | 48 |
| $t_7$ | 35 | 28 | 31 | 30 | 36 | 44 | 33 | 28 |

Figure 3:
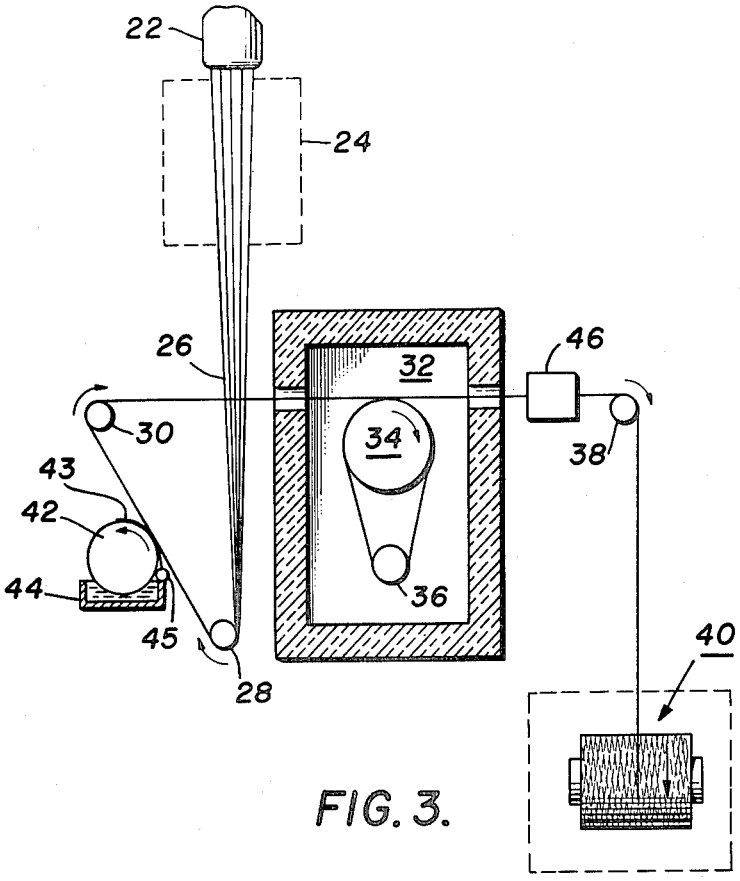
FIG. 3 is a schematic elevation view of modified apparatus for producing the novel yarns.

FIG. 3 illustrates an alternative machine configuration which differs from the FIG. 1 apparatus in that finish roll 42 is positioned after roll 28. This arrangement permits further flexibility in tailoring the physical properties of the yarn to a desired end use.

Table 3 sets forth representative processing conditions for the FIG. 3 configuration when making a weaving yarn. The polymer used in the Table 3 process contains 0.5% $TiO_2$ by weight and is selected so that the resulting yarn will have a relative viscosity of about 38. Quenching conditions are the same as for Items A–H above.

TABLE 3

| Item | I |
|---|---|
| Feed Roll Surface Temperature (°C.) | 183 |
| Roll 28 Turbine Air Pressure (PSIG) | −40 |
| Roll 28 approximate speed (YPM) | 3350 |
| Feed Roll 34 Speed (YPM) | 5004 |
| Winding Speed (YPM) | 4895 |
| Winding Tension (grams) | 7 to 9 |
| Roll 30 turbine air pressure (PSIG) | 0 |
| Roll 38 Turbine Air Pressure (PSIG) | 60 |

Figure 4:
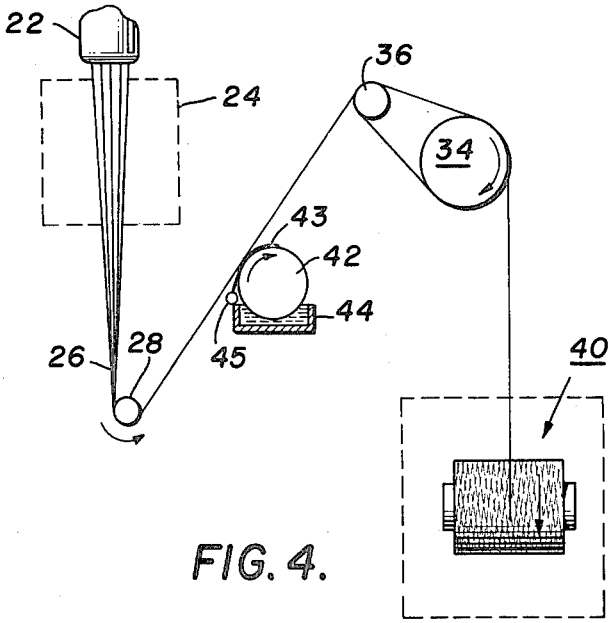
FIG. 4 is a schematic elevation view of a further modified apparatus for producing the novel yarns.

FIG. 4 illustrates a further apparatus and process particularly adapted for making feed yarns for texturing, the textured yarn in fabric form having a soft luxuriant hand. Roll 28 is positioned 125 inches below spinneret 22. Yarn 26 makes a partial wrap of about 180 degrees around roll 28. The distance from roll 28 to roll 36 is 48 inches. While roll 28 is the same as in FIGS. 1 and 3 above, roll 34 has a diameter of 5.9 inches in this example. Yarn 26 makes six and a fraction wraps about rolls 36 and 34, giving a total residence or contact time on roll 34 of about 18.6 milliseconds at the speed indicated below.

Table 4 shows exemplary operating conditions for the FIG. 4 apparatus. The polymer and the quenching conditions in the Table 4 process are the same as for the Table 3 process.

TABLE 4

| ITEM | J |
|---|---|
| Feed Roll surface temperature, °C. | 158 |
| Feed Roll speed (YPM) | 5151 |
| Roll 28 speed without yarn (YPM) | 3327 |
| Winding speed (YPM) | 4322 |
| Tension just above roll 28 (gms.) | 34 |
| Tension between rolls 28 and 42 (gms.) | 16 |
| Tension between rolls 42 and 36 (gms.) | 21 |
| Winding tension (gms.) | 8 |

The yarns produced by Items A–J are tested by the following procedures.

PHYSICAL PROPERTIES TESTING PROCEDURES

All physical property tests which are performed are conducted under the following conditions: 74°±2° F. and 72%±3% RH. With the exception of retraction, all samples are conditioned in this controlled environment for at least three days prior to testing. All bobbins are stripped of surface defects or a minimum of 25 meters of yarn prior to testing.

Normal Boiling Water Shrinkage Method

After stripping sufficient yarn to eliminate any surface defects (a minimum of 25 meters) on the bobbin, a skein of yarn is wound on a Suter Silk Reel, Singer Reel or equivalent which winds 1.125 meters of yarn per revolution. A sample having a weight of 1.125 grams is wound, removed from the reel and the ends of yarn are tied together. Winding tensions are 2 grams maximum up to 400 denier, 6±2 grams for 400–800 denier and 8±2 grams for 800–1700 denier. A No. 1 paper clip (weighing approximately 0.51 grams) is attached to the skein in a manner to encompass the full filament bundle. The skein is then hung over a one-half inch diameter stainless steel rod which is then placed in front of a shrinkage measuring board (a precision chart to determine sample length). A 1000 gram weight is attached to the paper clip and after a 30-second wait, the sample length ($L_o$) is determined. Care is taken to eliminate parallax errors in reading sample length.

The 1000 gram weight is removed and replaced with a 284 gram brass weight; this weight is not removed until the final length measurement is to be made. The rod, the skein of yarn and the attached 284 gram weight is suspended (with the weight applying full tension) in a vigorously boiling covered water bath for 10±2 minutes. The rod with its associated yarn skein and weight is removed and excess water allowed to drain (2–3 minutes). Then the samples are placed in a forced draft oven in such a manner that they remain under full tension for 15 minutes. The oven temperature is controlled at 115±5 Deg. C. The rod and its associated weighted skein is removed from the oven and returned to the shrinkage measuring board where it is allowed to hand for a minimum of 10 minutes (but no greater than 30 minutes). The attached 284 gram weight is removed and replaced with the 1000 gram weight, and 30 seconds thereafter the final length ($L_f$) is measured. The shrinkage (S) is then calculated as follows:

$$\%S = \frac{(L_o - L_f) \times 100}{L_o}$$

If nine consecutive samples are measured the average shrinkage level of the yarn on the bobbin at 95% confidence will be within ±0.24 of the true value.

All shrinkages are determined by this method, or determined by the short length method described below and calculated or corrected to correspond to the normal boiling water shrinkage method.

Short Length Boiling Water Shrinkage Method

This method is used only when the test sample is not of sufficient length to directly determine the normal boiling water shrinkage (S). A sample length of at least 70 cm. is treated in the following manner. A knot is tied on each end of the filament bundle to prevent the filaments from disengaging from the thread-line bundle during subsequent operations. The sample is then clamped at one end and a weight attached to the free end which places the sample under a tension of 0.1 grams per denier. The sample is mounted in such a manner that no contact is made with any other surfaces. While the sample is in this position, two marks are made 50 cm. apart with an indelible pen on the fiber bundle. The sample is then placed on a piece of cheesecloth approximately 11 inches square in the following manner. The yarn is formed into a loose coil having a diameter between 2 and 3 inches which is placed in the center of the flat cheesecloth. Fold one side of the cheesecloth wrapper over the coil, then fold opposite side and overlap initial fold. Repeat this operation on the other sides and secure the last folds made by applying a No. 1 paper clip perpendicular to the last folds. This secures the package and does not apply any restraining forces to the yarn coil. The resultant package is flat and about 3 inches square. The package is then submerged in boiling water for 20±2 minutes. After the package is removed, it is cooled with tap water and excess moisture is removed from the package with a sponge. The sample is then carefully removed from the cheesecloth and suspended without any tension applied to the threadline for 2±0.1 hours.

The sample is again tensioned with the original 0.1 gram per denier weight and the distance between the two marks measured ($L_f$) in cm. The short length shrinkage (S*) is then determined as follows:

$$\%S^* = \frac{(L_o - L_f) \times 100}{L_o}$$

A surprisingly good correlation exists between the normal boiling water shrinkage S and the short length boiling water shrinkage S* as shown by a coefficient of correlation of 0.9670. The estimated normal boiling water shrinkage (S) can be determined by the following relationship:

$$\%S = (0.96428)\,(\%S^*) - 0.41884$$

It will be noted that the estimated normal boiling water shrinkage S shows a lower value then the short length boiling water shrinkage S*.

If a yarn sample having a length of at least 70 cm is not available, shorter length samples can be used and the normal boiling water shrinkage calculated as noted above, however, accuracy decreases with decreasing sample length.

Retraction Method

Retraction is measured within 28 hours after the yarn is produced. A minimum of 1000 yards is stripped from the freshly wound bobbin. A skein of yarn is then wound on a Suter Silk Reel or equivalent, which winds 1.125 meters of yarn per revolution. A sample having a weight of 1.125 grams is wound, removed from the reel and the yarn ends are tied together. Winding tensions are 2 grams maximum up to 400 denier, 6±2 grams for 400–800 denier, and 8±2 grams for 800–1700 denier. A No. 1 paper clip (weighing approximately 0.51 ) grams) is attached to the skein in a manner to encompass the full filament bundle. The skein is then hung over a one-half inch diameter stainless steel rod which is then placed in front of a shrinkage measuring board (a precision chart to determine sample length). A 1000 gram weight is attached to the paper clip and, after a 30-second wait, the sample length ($L_o$) is determined. Care is taken to eliminate parallax errors in reading sample length.

The 1000 gram weight is removed and the sample is allowed to hang for 24±0.1 hours. The 1000 gram weight is attached to the paper clip and 30 seconds thereafter the final length ($L_f$) is measured. The percent retraction ($S_r$) is then calculated as follows:

$$\% S_r = \frac{(L_o - L_f) \times 100}{L_o}$$

Tensile Properties

The stress-strain properties are measured with an Instron Tensile Tester (Model No. TMM, manufactured by the Instron Engineering Corporation of Quincy, Mass.) using a load cell and amplification which will cause the point of maximum deflection of the stress-strain curve to be greater than 50% of the width of the recording chart. The sample length is 25 cm, the rate of extension is 120% per minute, and the chart speed is 30 cm per minute.

The initial modulus is defined as 100 times the force in grams per denier (g/d) required to stretch the yarn the first 1%.

In determining the tangent moduli, 10% modulus ($M_t$) and final modulus ($M_f$), the calculated deniers at the given strains are used. For a given strain (E), expressed as the ratio of sample extension (change in length) to original sample length, the calculated denier is given by the following relationship:

$$D = D_o/(1+E)$$

The calculated denier D at 0.1 strain, that is, when the yarn has been stretched to a total length of 27.5 cm., is thus equal to $D_o/1.1$.

The 10% modulus ($M_t$) is defined as follows:

$$M_t = \frac{P_{.1} - P_{.09}}{(.01)\,D}$$

where $P_{0.1}$ is the force in grams at a strain of 0.1, $P_{0.09}$ is the force in grams at a strain of 0.09, and D is the calculated denier at 0.1 strain.

The final modulus ($M_f$) is calculated at the point of first filament breakage. The force $P_f$ at this strain $E_f$ is used with the force $P_y$ at a strain $E_y$ equal to $E_{(f-0.05)}$. The final modulus $M_f$ is calculated as follows:

$$M_f = \frac{P_f - P_y}{(0.05)\,D}$$

where $P_f$ and $P_y$ are the forces noted and D is the calculated denier at strain $E_f$.

In some cases, the point of first filament breakage ($E_f$, $P_f$) occurs prior to reaching the point of maximum force ($E_m$, $P_m$). Only those stress-strain curves which have a $P_f/P_m$ ratio of at least 0.95 are used to calculate the values of $M_i$, $M_t$ and $M_f$.

The modulus ratio (R) is calculated as follows:

$$R = M_t/M_f$$

The stress index $\alpha$ is defined as follows:

$$\alpha = \frac{200}{P_{.1}}(P_{.05} - 0.45P_{.1})$$

where $P_{0.05}$ is the force in grams at 0.05 extension and $P_{0.1}$ is the force in grams at 0.1 extension.

The elongation at break is a percentage, defined as 100 times $E_m$.

Uster Uniformity

Denier uniformity is determined using the Uster Evenness Tester, Model C, together with integrator ITG-101 for this instrument. The yarn speed is 200 YPM, the service selector is set on normal, and the sensitivity selector is set to 12.5%. The %U is read from the integrator after a sample run time of 5 minutes.

Yarn Relative Viscosity

Relative viscosity (R.V.) is defined as the ratio of the absolute viscosity in centipoises at 25° C. of a solution containing 8.4 parts by weight of the yarn dissolved in 91.6 parts by weight of 90% formic acid (10% by weight water and 90% by weight formic acid) to the absolute viscosity at 25° C. in centipoises of the 90% formic acid.

YARN PROPERTIES

Table 5 shows the physical properties of the yarns produced by the processes disclosed above, and compares these properties with those of commercially available yarns having the same nominal denier and the same number of filaments. The data reported are the average of at least five bobbins for all items. Item K is a commercially available nylon 66 premium quality yarn produced by a single-stage-draw coupled process; item L is a commercially available nylon 66 premium quality yarn believed to be produced by a two-stage-draw coupled process; Item M is a commercially available nylon 66 yarn produced by a two-stage-draw coupled process, and item N is a commercially available nylon 66 yarn produced by the split process. Items K, L and M are relaxed yarns, that is, they were heat-treated under appropriate tensions so as to reduce the shrinkage. Item N was not heat-treated and is not a relaxed yarn, as evidenced by the high shrinkage. All items are flat (untextured) yarns.

TABLE 5

| ITEM | A | B | C | D | E | F | G | H | I | J | K | L | M | N |
|---|---|---|---|---|---|---|---|---|---|---|---|---|---|---|
| Properties: | | | | | | | | | | | | | | |
| Drawn Denier, $D_o$ | 70 | 70 | 68 | 68 | 69 | 67 | 68 | 68 | 70 | 86 | 69 | 71 | 71 | 71 |
| Tenacity, (g/d) | 3.8 | 4.4 | 3.9 | 4.5 | 4.7 | 3.9 | 4.8 | 4.9 | 5.2 | 4.3 | 5.3 | 5.2 | 4.6 | 5.0 |
| Elongation, (%) | 57 | 52 | 55 | 46 | 39 | 45 | 44 | 37 | 43 | 59 | 39 | 26 | 38 | 31 |
| Shrinkage, S (%) | 5.5 | 6.2 | 6.0 | 6.6 | 7.8 | 5.4 | 6.0 | 6.5 | 5.6 | 4.0 | 5.0 | 4.0 | 6.9 | 10 |
| Uster unevenness (%U) | .67 | .57 | .64 | .63 | .55 | .59 | .52 | <.50 | <.50 | 1.3 | .67 | .69 | 1.2 | 1.5 |
| Initial Modulus, $M_i$(g/d) | 19 | 21 | 19 | 25 | 27 | 23 | 24 | 27 | 29 | 21 | 25 | 25 | 25 | 28 |
| 10% Modulus, $M_1$ (g/d) | 8.2 | 11 | 9.1 | 13 | 17 | 12 | 16 | 20 | 15 | 9.6 | 30 | 23 | 34 | 31 |
| Final Modulus, $M_f$(g/d) | 8.2 | 8.5 | 8.4 | 9.0 | 9.3 | 8.0 | 8.9 | 9.5 | 7.6 | 7.1 | 7.4 | 6.5 | 4.9 | 5.2 |
| Modulus Ratio (R) | 1.0 | 1.3 | 1.1 | 1.5 | 1.8 | 1.5 | 1.8 | 2.2 | 2.0 | 1.4 | 4.2 | 3.7 | 7.1 | 6.1 |
| Stress Index ($\alpha$) | 31 | 23 | 32 | 21 | 9 | 26 | 18 | 9 | 28 | 37 | −6 | −5 | −9 | −2 |

X-RAY ANALYSIS

Final Spun Yarn Sample

These samples are obtained using two electrically actuated simultaneous cutters for cutting out a yarn sample. The samples were taken at a location just prior to contact of the freshly solidified filaments with the first surface which they contact. In the FIG. 1 apparatus, the sample would thus be taken just above roll 42, while in the other illustrated embodiments, it would be taken just above roll 28. The samples thus cut from the running yarn are placed in a moisture-free environment as soon as possible and maintained dry throughout the X-ray exposure to be described. Placing the yarn sample immediately after cutting into a box previously flushed with dry nitrogen gas, closing the box and pressurizing the box with dry nitrogen gas is a satisfactory technique.

Reference Spun Yarn Sample

These samples are made using an identical polymer type, conventionally spun. The spun yarn is steamed prior to being wound on a conventional spin bobbin at 1463 meters/minute. The spin bobbin is then lagged for 2 days in an air atmosphere at about 23° C. and 70% relative humidity. A length of yarn is cut from the bobbin after stripping about 100 yards of surface yarn.

X-Ray Techniques

The x-ray diffraction patterns are recorded on NS54T Kodak no-screen medical x-ray film using evacuated flat plate Laue cameras (Statton type). Specimen to film distance is 5.0 cm; incident beam collimator length is 3.0 inches, exposure times 25 minutes. Interchangeable Statton type yarnholders with 0.5 mm diameter pinholes and 0.5 mm yarn sheaf thickness are used throughout as well as 0.5 mm entrance pinholes. The filaments of each sheaf of yarn are aligned parallel to one another and perpendicular to the x-ray beam. A copper fine focus x-ray tube ($\lambda$=1.5418 Å) is used with a nickel filter at 40 KV and 26.26 mA, 85% of their rated load. For each x-ray exposure, three films are used in the film cassettes. The front, most intense film provide information on any weak diffraction maxima. The second and third films, lighter by factors of approximately 3.8 and 14.4 respectively, yield details on the more intense maxima and provide reference intensities used in estimating particle size and orientation from spot widths.

The principal equatorial x-ray diffraction maxima are used to determine the average lateral crystal particle size. For the (100) reflection this corresponds to the average width of the hydrogen bonded sheets of polymer chains, and for the higher angle (010) reflection this corresponds to the thickness of the crystallites in the direction of packing of the hydrogen bonded sheets. These sizes are estimated from the breadth of the diffraction maxima using Scherrer's method, $$D=K\lambda/\beta \cos \theta,$$

where K is the shape factor depending on the way $\beta$ is determined as discussed below, $\lambda$ is the x-ray wave length, in this case, 1.5418 Å, $\theta$ is the Bragg angle, and $\beta$ is the spot width in respect to 2 $\theta$ in radians.

Warren's correction for line broadening due to instrumental effects is used as a correction for Scherrer's line broadening equation, $$W^2=w^2+\omega^2$$

where W is the measured line width, w=0.39 mm is the instrumental contribution obtained from inorganic standards, and $\omega$ is the corrected line width used to calculate the spot width in radians, $\beta$. The measured line width, W, is taken as the width at which the diffraction intensity on given film falls to the maximum intensity of the corresponding next lighter film, or approximately the width at 1/3.8 of the maximum intensity. Correspondingly, a value of 1.16 is employed for the shape factor K in Scherrer's equations. Any broadening due to variation of periodicity is neglected.

Crystalline orientation is determined from the angular widths, $\phi$ 1/3.8, of the two principal equatorial reflections (010) and (100). These are estimated visually at 1/3.8 peak height using successive films in the film cassette for reference. These are converted to Herman's orientation functions, $$F=3/2<\cos^2 \phi>-\tfrac{1}{2},$$

assuming Gaussian peak shapes, $$I(\phi)\simeq(h/\pi) \exp(-h^2\phi^2).$$

This representation has been reported to be satisfactory in many cases by Dumbleton et al [J. H. Dumbleton, D. R. Buchanan, and B. B. Bowles, *J. Appl. Polymer Sci.*, 12, 2067–2076 (1968)]. The shape of the peak is then given by a single factor, such as the peak width at 1/3.8 height, related to h by, $$h=2.311/\phi_{1/3.8}$$

For samples for which $\phi_{1/3.8}$ is greater than 180°, h is estimated from the ratio of the intensity at 90° (i.e. on the meridan) to that on the equator, $$I_{90}/I_o=\exp-(90h)^2$$

In particular the mean square cosines are calculated by numerical integration using an HP-65, $$< \cos^2\phi > = \int_0^{90} I(\phi)\cos^2\phi\sin\phi d\phi / \int_0^{90} I(\phi)\sin\phi d\phi$$

which is a weighted mean with weights equal to the number of poles at any given angle $\phi$.

Crystalline orientation of the molecular chains is obtained following Wilchinsky's general treatment (Z. W. Wilchinsky, *Advances in X-Ray Analysis,* Vol. 6, Plenum Press, New York, 1963, pages 231–241. Described by L. E. Alexander, *X-Ray Diffraction Methods in Polymer Science,* John Wiley, 1969, pages 245–252). The equatorial (010) and (100) orientations are found to be similar, indicating near randomness about the C-axis; so the molecular chain or C-axis orientation simplifies to $$< \cos^2 \phi_{c,Z} > = 1 - 2 < \cos^2 \phi_{010,Z} >,$$

where $\cos \phi_{010,Z}$ is the cosine of the angle between the fiber between the fiber direction Z and the normal of the reflecting (010) planes, and $\cos \phi_{c,Z}$ is the similar cosine with respect to the C-axis (molecular chain direction). In terms of Herman's crystalline orientation function, the C-axis orientation function simplies to:

$$F_c = -2F_{010}$$

where $F_{010}$ is the b-axis orientation function, or more precisely in this triclinic case the orientation in respect to the b* reciprocal axis which is perpendicular to the c-axis.

In the present process, the molten polymer streams are subjected to much higher than normal stresses as they are attenuated to smaller than normal spun deniers. The molten streams are thus quenched more rapidly, and the resulting solidified spun yarn has a smaller hydrogen bonded sheet width than conventional yarns entering the draw zone.

As can be seen from a comparison of Tables 2–5, for a given speed of draw roll 34, yarn properties are controlled by varying the speeds of rolls 28, 30 and 38, and thus the yarn tensions, and by varying the temperature of roll 34. Generally speaking, slowing of either roll 28 or roll 30 relative to the speed of roll 34 increases tenacity and modulus values, and increases denier uniformity as measured by Uster analysis. The process is unusual in this latter respect, as well as in the achievement at such low processing tensions of yarn tenacities, elongations, and initial moduli similar to conventionally drawn yarn. It is likewise noteworthy that tenacity increases as the temperature of roll 34 increases, this being unexpected in view of the prior art.

A further factor which becomes important in forming large packages on disposable bobbins made of paper is that the retraction should be below 1%. Items A and B above (run without positively heating roll 34) have retractions above this value, and must be run on stronger and more expensive bobbins if satisfactory large packages are to be made without crushing the bobbin. Items C–J have retractions well below 1%, and can be conveniently wound on inexpensive paper bobbins. Of particular interest is the decrease in tension after roll 28 in Item J.

Yarn uniformity as measured by Uster analysis shows that Items A–G are at least comparable in average uniformity to the best available commercial yarns (Items K and L), while Items H and I are superior in this respect.

In addition to the yarn uniformity as measured by Uster analysis, the yarns in Items A–I exhibit a novel combination of shrinkage and stress-strain properties as indicated by the reported shrinkage and modulus values.

The last five properties listed in Table 5 are derived from a stress-strain diagram as detailed above. The initial modulus is a commonly measured parameter. The 10% modulus and the final modulus are tangent moduli, representing the stiffness of the yarn near 10% extension (0.1 strain) and near break, respectively. The modulus ratio is the ratio of the 10% modulus to the final modulus, and provides a measure of the general shape of the stress-strain curve. Finally, the stress index $\alpha$ is derived from the stresses at 5% and 10% extensions, and relates to the unusual soft hand observed in various fabrics made from yarns.

Yarns having the unusual softness of hand are those having a positive stress index $\alpha$ combined with a shrinkage less than 8.5% and an initial modulus greater than 15. The softness usually is more pronounced when $\alpha$ exceeds 15, and particularly so when the 10% modulus also is less than 17.

Suitable yarns for warping (for weaving or warp knitting) are those having an initial modulus of at least 17, a shrinkage less than 8.5%, and a modulus ratio less than 3, as typified by items D, E, G, and H. For filling yarns in weaving, the shrinkage should be between 1 and 6%, the initial modulus should be at least 17, and the yarn should have a modulus ratio less than 3, as exemplified by Item I. Advantageously, the initial modulus also exceeds 21 grams per denier (g/d). These warping and filling yarns preferably have elongations between 25 and 60% and final moduli greater than 7.5 g/d.

Suitable feed yarns for knitting or texturing such as Item E, have a shrinkage less than 8.5%, an initial modulus of at least 15 and a 10% modulus less than 22 g/d. These feed yarns for knitting or texturing preferably have elongations between 35 and 80%. For shock absorbing applications (e.g., tow ropes, anchor lines, barriers for restraining or confining vehicles, etc.), elongations preferably range between 35 and 120%.

Yarns of general utility, suitable for a wide variety of end uses including those mentioned above, have a shrinkage between 1 and 8.5%, a 10% modulus less than 22 g/d, a final modulus greater than 7.5 g/d, and a modulus ratio less than 3. Preferably such yarns have elongations between 35% and 60%.

These properties may be compared with further representative commercially available split process nylon 66 flat yarns, and with two experimental yarns, as shown in Table 6. In Table 6, Item O is 840 denier, 140 filament tire yarn; Item P is 20 denier, 7 filament yarn intended to be textured and knit into sheer hose; Item Q is 840 denier, 140 filament relaxed industrial yarn. The two experimental yarns, Items R and S, are made from split process spun yarns designed to be drawn to 70 denier, but are deliberately underdrawn to 89 and 82 denier, respectively.

TABLE 6

| Item | O | P | Q | R | S |
|---|---|---|---|---|---|
| Initial modulus (g/d) | 47 | 37 | 22 | 32 | 35 |
| 10% modulus (g/d) | 69 | 31 | 68 | 19 | 23 |
| Final modulus (g/d) | 23 | 5 | 20 | 7 | 6.5 |
| Modulus ratio (R) | 3 | 6.2 | 3.5 | 2.7 | 3.5 |
| Shrinkage (%) | 10 | 10 | 4.9 | 12 | 11 |

TABLE 6-continued

| Item | O | P | Q | R | S |
|---|---|---|---|---|---|
| Stress ($\alpha$) | −19 | −3.7 | −22 | 12 | 10 |

None of these items have combinations of properties comparable to Items A–J above. Item O, while having a final modulus of 23, has a very high 10% modulus, together with high shrinkage and a negative stress index $\alpha$. Item P has all properties (aside from initial modulus) outside the ranges for the yarns of the invention. Item Q has an acceptably high final modulus and low shrinkage, but the other properties are far outside the ranges for the yarns of the invention.

Experimental Items R and S, which do exhibit the desirable positive values for the stress index $\alpha$, couple this with shrinkages as high as tire yarn and low final moduli.

Figure 5:
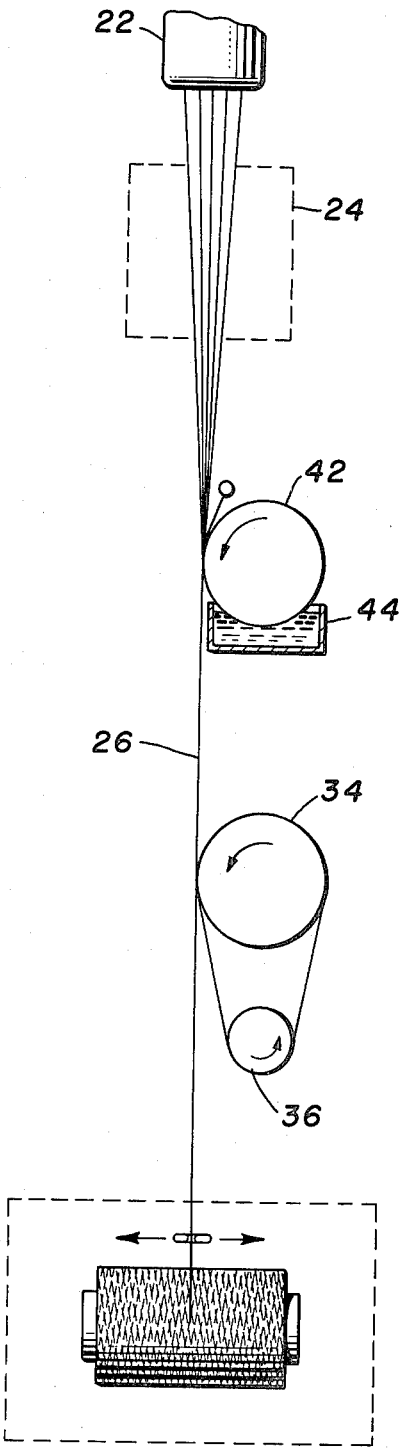
FIG. 5 is a schematic elevation view of a simplified apparatus for producing the novel yarn.

The broadest aspects of the process are illustrated in FIG. 5, wherein yarn 26 has finish applied by finish roll 42, then passes in seven wraps around heated roll 34 and its associated separator roll 36. Roll 34 has a diameter of 6 inches and is operated with a surface temperature of 155° C. Roll 36 has a 2 inch diameter, and is located such that when roll 34 has a peripheral speed of 4029 yards per minute, yarn 26 will have a total residence time in contact with roll 34 of 31.4 milliseconds.

In the FIG. 5 apparatus, the distance from spinneret 22 to finish roll 42 is 215 inches, while the distance from finish roll 42 to roll 34 is 17 inches. Quench zone 24 has a height of 46 inches.

The polymer contains 0.5% $TiO_2$ by weight and is selected so that the resulting yarn will have a relative viscosity of about 38–40. Quenching conditions are the same as above except that the average velocity of the quenching air is 57.5 feet per minute.

Yarns according to the invention accordingly have unique and desirable combinations of physical properties, which combinations are not present in the prior art.

We claim:

1. A process of melt spinning nylon 66, comprising:

a. extruding nylon 66 polymer of fiber-forming molecular weight as a plurality of molten streams, b. solidifying said streams into solid filaments while withdrawing said filaments from said streams at a sufficiently high speed to provide a tension within the range between 0.2 and 1.5 grams per final denier;

c. maintaining said filaments under tension within said range while forwarding said filaments at least 0.016 and less than 0.11 seconds after solidification to a treatment zone wherein said filaments are heated to between 50° C. and 250° C. for a period sufficient to reduce the yarn retraction to less than 1%; and d. withdrawing said filaments from said treatment zone.

2. The process defined in claim 1, wherein said filaments are forwarded to said treatment zone between 0.03 and 0.06 seconds after solidification.

3. A process of melt spinning nylon 66, comprising:

a. extruding nylon 66 polymer of fiber forming molecular weight as a plurality of molten streams, b. solidifying said streams into solid filaments while withdrawing said filaments from said molten streams at a speed sufficient to produce a final spun yarn having a Hermann's orientation function Fc of at least 0.78 and c. maintaining said filaments under a tension of 0.2 and 1.5 grams per final denier while forwarding said filaments at least 0.016 and less than 0.11 seconds after solidification to a treatment zone wherein said filaments are heated to between 50° C. and 250° C. for a period sufficient to reduce the yarn retraction to less than 1%; and d. winding said filaments on a bobbin.

4. A process of melt spinning nylon 66, comprising:

a. extruding nylon 66 polymer of fiber forming molecular weight as a plurality of molten streams, b. solidifying said streams into solid filaments while withdrawing said filaments from said molten streams at a speed sufficient to produce a final spun yarn having a Hermann's orientation function Fc of at least 0.85, and c. maintaining said filaments under a tension of 0.2 and 1.5 grams per final denier while forwarding said filaments at least 0.016 and less than 0.11 seconds after solidification to a treatment zone wherein said filaments are heated to between 50° C. and 250° C. for a period sufficient to reduce the yarn retraction to less than 1%; and d. winding said filaments on a bobbin.

5. A process of melt spinning nylon 66, comprising:

a. extruding nylon 66 polymer of fiber forming molecular weight as a plurality of molten streams;

d. solidifying said streams into solid filaments while withdrawing said filaments from said molten streams at a speed sufficient to produce a final spun yarn having a crystallite hydrogen bonded sheet width no greater than 85% of the crystallite hydrogen bonded sheet width of a reference spun yarn sample, and c. maintaining said filaments under a tension of 0.2 and 1.5 grams per final denier while forwarding said filaments at least 0.016 and less than 0.11 seconds after solidification to a treatment zone wherein said filaments are heated to between 50° C. and 250° C. for a period sufficient to reduce the yarn retraction to less than 1%; and d. winding said filaments on a bobbin.

6. A process of melt spinning nylon 66, comprising:

a. extruding nylon 66 polymer of fiber forming molecular weight as a plurality of molten streams, b. solidifying said streams into solid filaments while withdrawing said filaments from said molten streams at a speed sufficient to produce a final spun yarn having a crystallite hydrogen bonded sheet width no greater than 75% of the crystallite hydrogen bonded sheet width of a reference spun yarn sample, and c. maintaining said filaments under a tension of 0.2 and 1.5 grams per final denier while forwarding said filaments at least 0.016 and less than 0.11 seconds after solidification to a treatment zone wherein said filaments are heated to between 50° C. and 250° C. for a period sufficient to reduce the yarn retraction to less than 1%; and d. winding said filaments on a bobbin.

* * * * *

UNITED STATES PATENT AND TRADEMARK OFFICE

CERTIFICATE OF CORRECTION

PATENT NO. : 4,228,120

DATED : October 14, 1980

INVENTOR(S) : James E. Bromley et al

It is certified that error appears in the above-identified patent and that said Letters Patent are hereby corrected as shown below:

Column 2, line 58, "small" should read --smaller--.

Column 7, line 19, "72% ± 3%" should read --72% ± 2%--.

In Table 5, columns 11-12, under Item H, the figure "2.2" given for Modulus Ratio (R) should read --2.1--.

Column 16, line 4 in claim 5, "d." should read --b.--.

Signed and Sealed this

*Eighth* Day of *December 1981*

[SEAL]

*Attest:*

GERALD J. MOSSINGHOFF

*Attesting Officer*

*Commissioner of Patents and Trademarks*